US011434053B2

(12) United States Patent
Schuster et al.

(10) Patent No.: US 11,434,053 B2
(45) Date of Patent: Sep. 6, 2022

(54) BOTTLE CAP AND INSERT APPARATUS

(71) Applicant: NCH Life Sciences LLC, Irving, TX (US)

(72) Inventors: Michael J. Schuster, Shorewood, IL (US); Thomas R. Bajek, Naperville, IL (US)

(73) Assignee: NCH Life Sciences LLC, Irving, TX (US)

( * ) Notice: Subject to any disclaimer, the term of this patent is extended or adjusted under 35 U.S.C. 154(b) by 0 days.

(21) Appl. No.: 17/104,017

(22) Filed: Nov. 25, 2020

(65) Prior Publication Data

US 2021/0155385 A1 May 27, 2021

Related U.S. Application Data

(60) Provisional application No. 62/940,447, filed on Nov. 26, 2019.

(51) Int. Cl.
*B65D 47/06* (2006.01)
*B65D 51/16* (2006.01)
*B65D 53/02* (2006.01)

(52) U.S. Cl.
CPC ..... *B65D 47/06* (2013.01); *B65D 51/1616* (2013.01); *B65D 53/02* (2013.01)

(58) Field of Classification Search
CPC ..... B65D 47/06; B65D 51/1616; B65D 53/02
See application file for complete search history.

(56) References Cited

U.S. PATENT DOCUMENTS 4,832,237 A * 5/1989 Hurford, Jr. ..... F16L 37/0841 222/189.1
6,045,012 A * 4/2000 Hansen ..... F02M 37/0017 114/343
6,142,345 A * 11/2000 Laible ..... B67D 7/0277 222/189.1
6,837,400 B2 * 1/2005 Leoncavallo ..... B01L 3/10 222/189.09
8,083,107 B2 * 12/2011 Laible ..... B65D 47/283 222/478
8,844,776 B2 * 9/2014 Haas ..... B67D 7/0294 222/481.5
9,242,847 B1 * 1/2016 Laible ..... B67D 7/0294
10,336,517 B1 * 7/2019 Laible ..... B65D 47/32
10,414,644 B1 * 9/2019 Laible ..... B67D 7/0294
(Continued)

*Primary Examiner* — Frederick C Nicolas
(74) *Attorney, Agent, or Firm* — Thomas | Horstemeyer, LLP

(57) ABSTRACT

Disclosed are various embodiments of a bottle cap apparatus configured for dispensing fluids through a sealed channel. In one example, the bottle cap apparatus comprises a cap, an insert container, and a stem. The cap has a top platform with an aperture. The insert container has a first end and a second end. The first end has a first opening that is positioned adjacent to an underside of the top platform of the cap. The second end having a recessed bottom with a second opening. The stem having a platform between a first end and a second end. The second end of the stem is positioned within the recessed bottom of the insert container. The first end being extended through the aperture of the cap. A dispensing channel is formed from the components of the bottle cap apparatus and is configured to allow a fluid be extracted from a bottle.

19 Claims, 8 Drawing Sheets

(56) References Cited

U.S. PATENT DOCUMENTS

| | | | | |
|---|---|---|---|---|
| 10,414,645 | B1 * | 9/2019 | Laible | B67D 7/0294 |
| 10,508,016 | B1 * | 12/2019 | Laible | B67D 7/0294 |
| 10,640,359 | B1 * | 5/2020 | Laible | B65D 51/16 |
| 10,815,117 | B1 * | 10/2020 | Loreto | B67D 7/0294 |
| 2004/0173636 | A1 * | 9/2004 | Leoncavallo | B65D 1/323 222/189.09 |
| 2010/0213220 | A1 * | 8/2010 | Laible | B67D 7/0294 222/481.5 |

* cited by examiner

BOTTLE CAP AND INSERT APPARATUS

CROSS REFERENCE TO RELATED APPLICATIONS

This application claims the benefit of, and priority to, U.S. Provisional Patent Application No. 62/940,447, entitled "BOTTLE CAP AND INSERT APPARATUS," filed on Nov. 26, 2019, which is hereby incorporated herein by reference in its entirety.

BACKGROUND

Bottles can be used to store various types of fluids. In some cases, bottles may be sealed to prevent containments from entering the interior of the bottle and affecting the fluid contents. While sealed, fluid content may need to be extracted from the bottle in a controlled manner.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

The present disclosure relates to a bottle cap apparatus configured for dispensing fluids through a sealed channel. The embodiments of the present disclosure prevent air or containments from entering the sealed channel. As such, fluid contents of a standard bottle can be drawn and dispensed out of a port attached to the bottle in a controlled manner. For example, in some scenarios, bottles can be used to hold chemical or biological solutions. In these scenarios, air and other containments can significantly affect the composition of these solutions. In some systems, chemical or biological solutions can be dispensed in small increments. Extracting these solutions in a controlled manner can be challenging depending on the viscosity or thickness of the solution. As the viscosity of a fluid increases, a greater extraction force is needed in order to draw fluids from a bottle. In these circumstances, it can be challenging to keep the interior of a container (e.g., a bottle) and a dispensing channel for the bottle uncontaminated.

Further, as fluid is extracted, air enters the bottle to equalize the pressure within the bottle. However, while equalizing the pressure, air needs to be prevented from entering the dispensing channel for the fluids. In some cases, air entering the dispensing channel can affect the composition of the fluid and ultimately its performance.

Figure 1A:
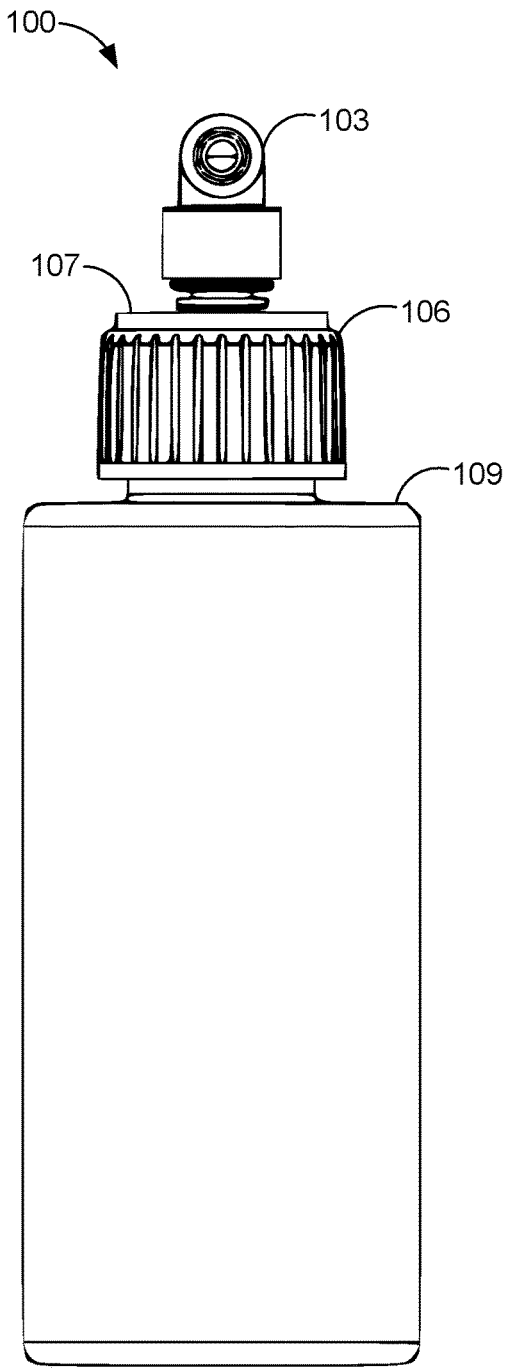
FIG. 1A is a front view of a bottle assembly, according to one embodiment described herein.
Figure 1B:
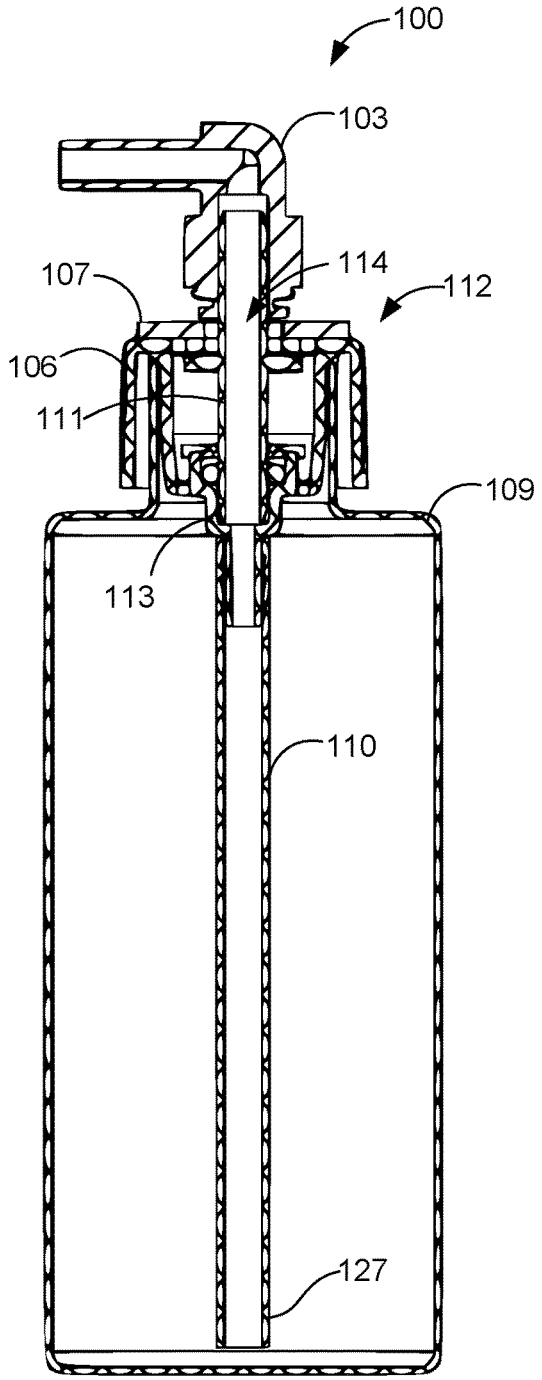
FIG. 1B is a cross-sectional view of the bottle apparatus, according to one embodiment described herein.

Beginning with FIG. 1A, shown is a front view of a bottle assembly 100. FIG. 1B illustrates a cross-sectional view of the bottle assembly 100 in FIG. 1A. The bottle assembly 100 includes a port fitting 103, a bottle cap 106, a filter 107, and a bottle 109. FIG. 1B illustrates that the bottle cap 106 attaches to the bottle 109. The bottle cap 106 and the bottle 109 can be a threaded connection or other suitable connections.

FIG. 1B also illustrates that the bottle cap 106 is a component of a bottle cap assembly 112, which is attached to the port fitting 103. The bottle cap assembly 112 can include the bottle cap 106, filter 107, a stem 111, an insert container 113, and other components. The filter 107 is positioned on top of the bottle cap 106. The insert container 113 is positioned within the bottle cap 106. The stem 111 attaches to the insert container 113 at one end. The stem 111 also extends through the bottle cap 106 and the filter 107. The stem 111 is attached to the port fitting 103.

Accordingly, the bottle cap assembly 112 is attached to the port fitting 103 at one end and is attached to a drop-tube 110 at the other end. Thus, the bottle cap assembly 112 forms a dispensing channel 114 that can include portions of the port fitting 103 and the drop-tube 110. Accordingly, fluid can be extracted from the interior cavity of the bottle 109 through the drop-tube 110, through the bottle cap assembly 112, through the port fitting 103, and through attached tubing. The attached tubing can dispense the fluid to another chamber of a system. Within the bottle cap assembly 112, the dispensing channel 114 is formed in part by aligning a bottom opening of the insert container 113 with an interior of the stem 111, which in turn is aligned with the port fitting 103.

The port fitting 103 can be attached to a tube that also connects to another component of a system. For example, the contents of the bottle 109 can be fed into another chamber, tank, or other suitable container. A pump may be used to extract the contents of the bottle 109 through the port fitting 103 and into another chamber. The port fitting 103 can be a press-to-connect fitting and other suitable port fittings.

The filter 107 can be positioned on top (or inside the bottle insert) of the bottle cap assembly 112, in particular on top of the bottle cap 106. The filter 107 can be used to filter air that enters through apertures in the bottle cap 106. The filter 107 can be a carbon filter or other suitable filters. In some examples, the filter 107 may have a micron rating between 0.05-0.25, in which a preferred micron rating may be approximately 0.2 (but may be much larger depending on the application). Also, the bottle 109 can be a standard bottle container, which can vary in size and capacity. The bottle cap assembly 112 can be manufactured to fit different sized bottles.

The drop-tube 110 can form a sealed connection with a portion of the bottle cap assembly 112. As illustrated, the drop-tube 110 surrounds a portion of the insert container 113 at one end. The sealed connection prevents air and other containments from entering the dispensing channel 114. The drop-tube 110 can be an elongated tube that extends into the interior cavity of the bottle 109. An end of the drop-tube 110 can have different shapes in order to prevent the positioning of the drop-tube 110 from blocking its opening. For example, near the bottom of the bottle 109 (reference number 127), the drop-tube 110 may have an end 127 with a slanted opening, a bird's beak shape, or other shapes. For instance, if the end 127 of the drop-tube 110 contacts the bottom of the bottle 109, then fluids can still enter the drop-tube 110 from the sides because of the slanted shape of the opening.

Figure 1C:
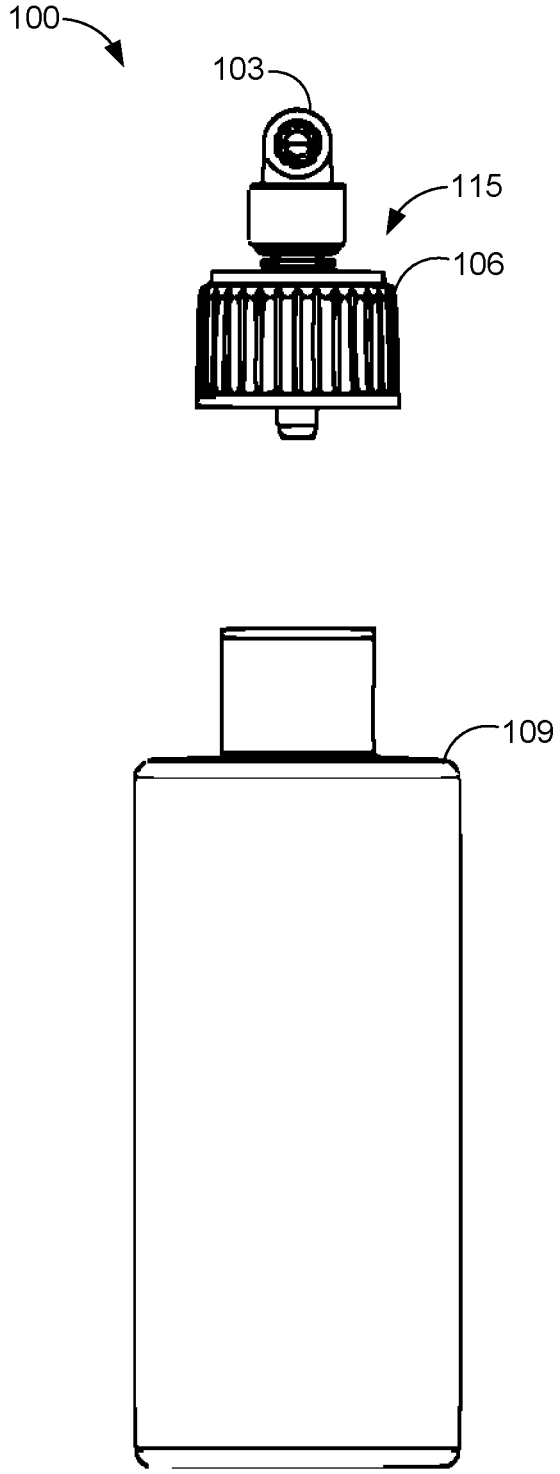
FIG. 1C is a front view of the bottle assembly in which a bottle cap is detached from a bottle, according to one embodiment described herein
Figure 1D:
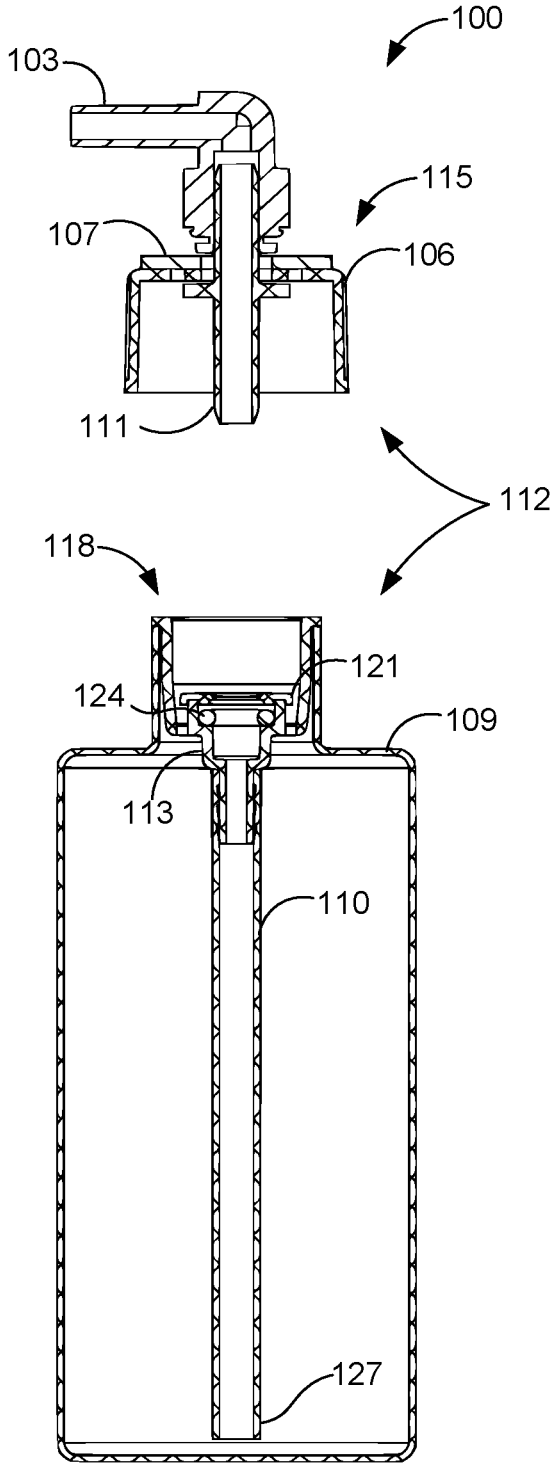
FIG. 1D is a cross-sectional view of the bottle assembly in FIG. 1C, according to one embodiment described herein.

FIG. 1C illustrates a front view of the bottle assembly 100 in which a portion of the bottle assembly 100 is detached from the bottle 109 in FIG. 1A. FIG. 1D illustrates a cross-sectional view of FIG. 1C. FIG. 1D illustrates that an upper portion 115 of the bottle cap assembly 112 detached from a lower portion 118 of the bottle cap assembly 112. The upper portion 115 can include the port fitting 103, the filter 107, the bottle cap 106, the stem 111, and other components. As illustrated, the stem 111 has been disconnected from the insert container 113. FIG. 1C illustrates that the port fitting 103, which is a press-to-connect fitting in this example, is attached to the stem 111. As a result, the port fitting 103, the bottle cap 106, and the stem 111 remain attached even if the bottle cap 106 is detached from the bottle 109.

The lower portion 118 of the bottle cap assembly 112 can include the insert container 113, the drop-tube 110, a plate 121, an o-ring 124, and other components. The plate 121 can be attached to the insert container 113 and can have an annular shape. The o-ring 124 can be a gasket or other suitable component that can be used to provide air and/or fluid seals between components.

Figure 2A:
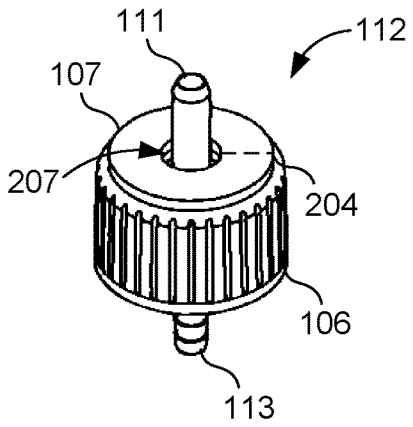
FIGS. 2A-2E illustrate various views of a bottle cap assembly, according to one embodiment described herein.
Figure 2B:
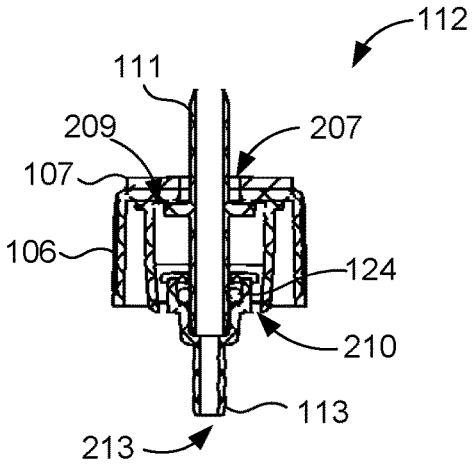
Figure 2C:
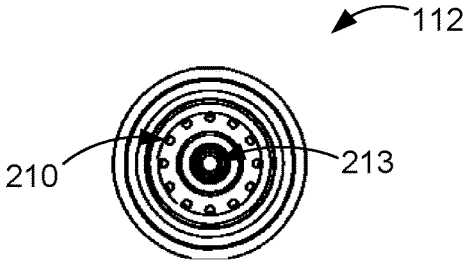
Figure 2D:
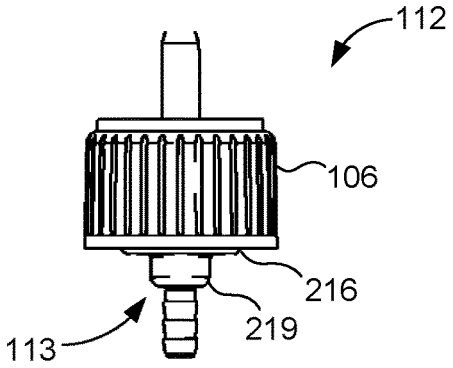
Figure 2E:
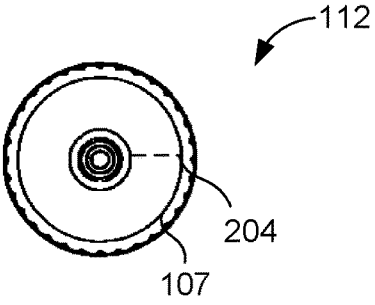

With reference to FIGS. 2A-2E, shown are various views of the bottle cap assembly 112. FIG. 2A illustrates a perspective view of the bottle cap assembly 112. FIG. 2B illustrates a cross-sectional view of the bottle cap assembly 112 from FIG. 1A. FIG. 2C illustrates a bottom-up view of the bottle cap assembly 112. FIG. 2D illustrates a side view of the bottle cap assembly 112, and FIG. 2C illustrates a top-down view of bottle cap assembly 112. In FIGS. 2A-2E, the port fitting 103 (FIGS. 1A-1D) and the drop-tube 110 (FIGS. 1A-1D) have been removed.

FIG. 2A illustrates that the filter 107 may have a slit 204. The slit 204 is a cut in the filter 107, which allows each end of the cut to be separated from each other. Thus, the slit 204 enables the filter 107 to be removed without disconnecting the port fitting 103 from the bottle cap assembly 112. Further, the filter 107 and the bottle cap 106 have a central aperture 207 in which the stem 111 extends through. The central aperture 207 also provides sufficient spacing in order for the port fitting 103 to attach at a top of or within the bottle cap 106. FIG. 2B illustrates that portions of the stem 111 are in contact with an underside of the bottle cap 106.

Also, FIG. 2C displays multiple peripheral openings 210 in the bottom of the insert container 113 that surround a bottom opening 213 of the insert container 113. FIG. 2D illustrates a bottom surface 216 of the insert container 113 extends below a bottom of the bottle cap 106. The bottom surface 216 extends from a recessed bottom 219 of the insert container 113.

Figure 3:
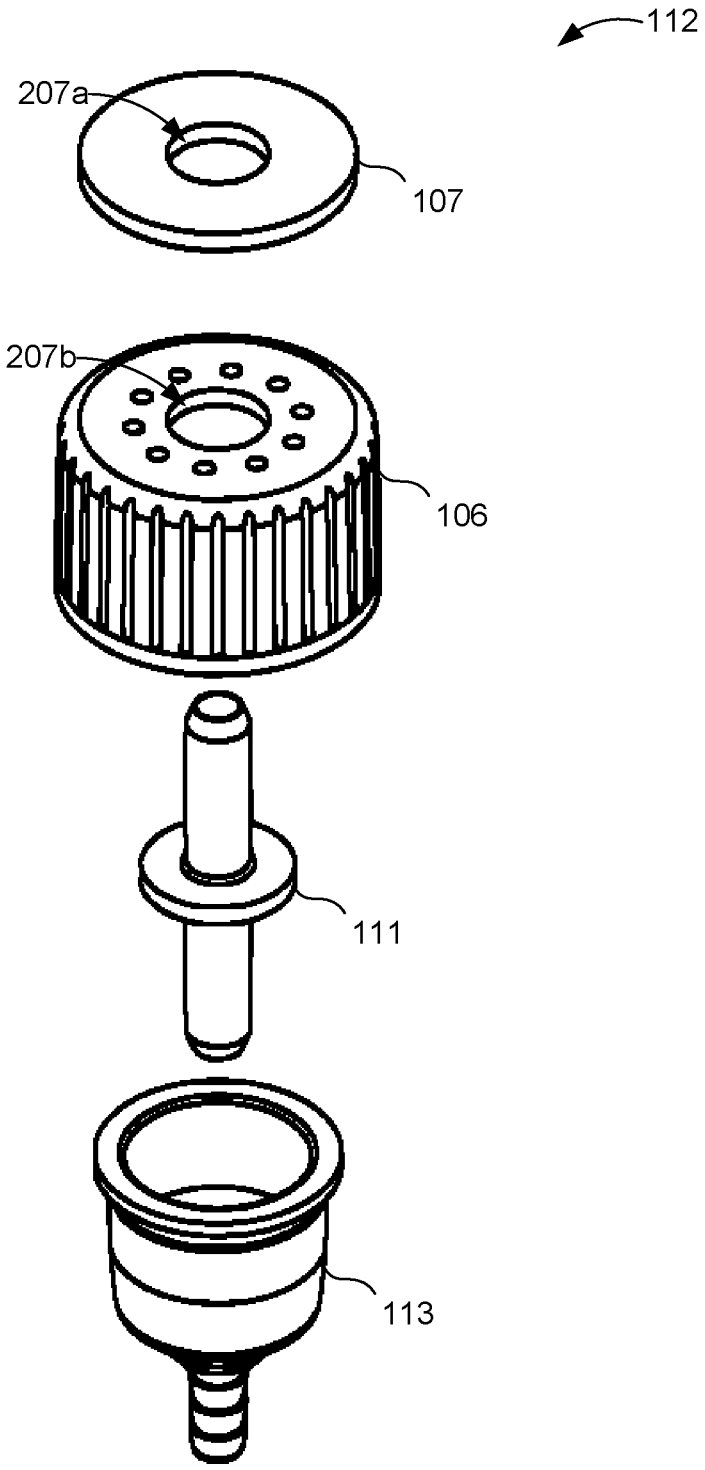
FIG. 3 illustrates an exploded view of the bottle cap assembly from FIGS. 2A-2E, according to one embodiment described herein.

With reference to FIG. 3, shown is an exploded view of the bottle cap assembly 112 from FIGS. 2A-2E. FIG. 3 illustrates that the filter 107 can be positioned on top of the bottle cap 106. An upper portion of the stem 111 extends through the first central aperture 207*a* of the filter 107 and the second central aperture 207*b* of the bottle cap 106. A lower portion of the stem 111 is connected to an interior of the insert container 113.

Figure 4A:
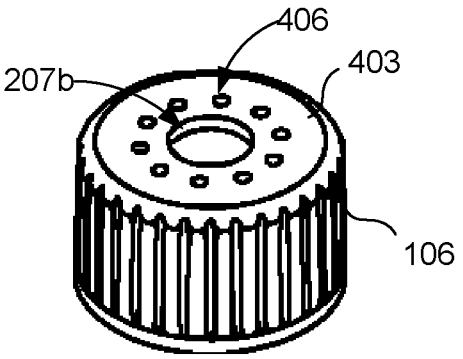
FIGS. 4A-4E illustrate various views of a bottle cap from FIGS. 1A-1D, according to one embodiment described herein.
Figure 4B:
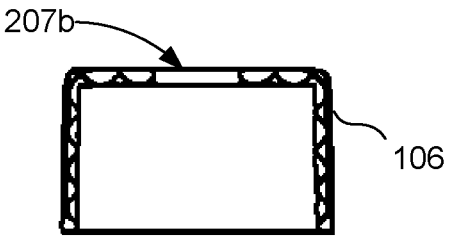
Figure 4C:
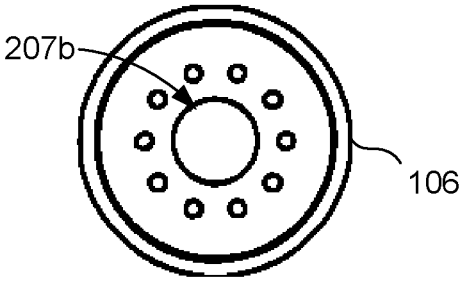
Figure 4D:
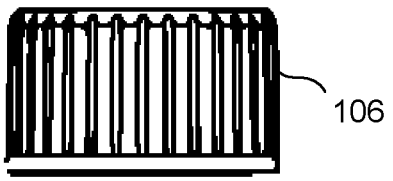
Figure 4E:
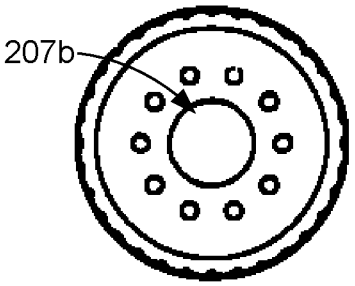

Moving on to FIG. 4A-4E, shown are various views of the bottle cap 106 from FIGS. 1A-1D. FIG. 4A illustrates a perspective view of the bottle cap 106. FIG. 4B illustrates a cross-sectional view of the bottle cap 106. FIG. 4C illustrates a bottom-up view of the bottle cap 106. FIG. 4D illustrates side view of the bottle cap 106, and FIG. 4E illustrates a top-down view of bottle cap 106.

The bottle cap 106 has a top platform 403 with multiple peripheral apertures 406 that surround the second central aperture 207*b*. The multiple peripheral apertures 406 allow air to enter the bottle cap assembly 112 (FIGS. 1A-1D) when fluid is extracted from the interior of the bottle 109. The air travels through an air channel (FIG. 5B (521)) within the bottle cap assembly 112. After air passes through the peripheral apertures 406, the air passes between the inner surface of the insert container 113 and the stem 111. Then, the air travels downward and through the bottom opening 213 of the insert container 113. After the air leaves the bottom opening 201, it enters the interior of the bottle 109.

Figure 5A:
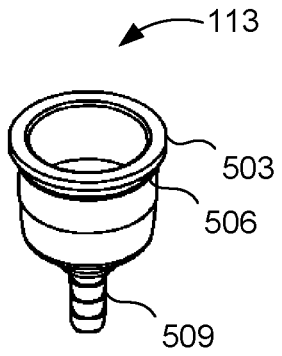
FIGS. 5A-5E illustrate various views of an insert container from FIGS. 1A-1D, according to one embodiment described herein.
Figure 5B:
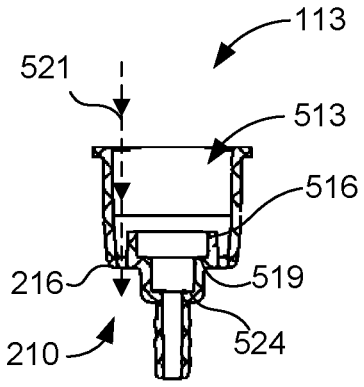
Figure 5C:
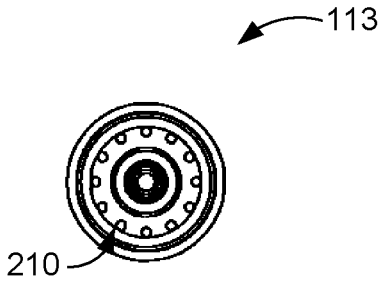
Figure 5D:
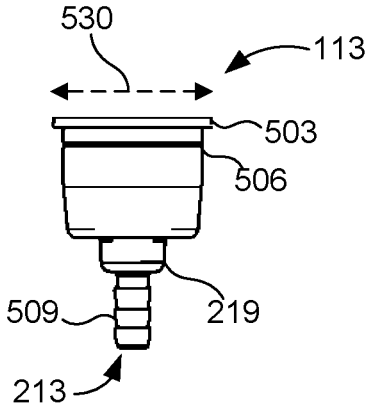
Figure 5E:
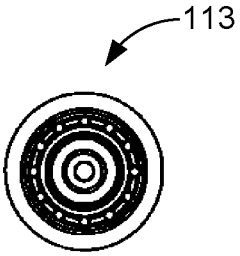

Moving on to FIG. 5A-5E, shown are various views of the insert container 113 from FIGS. 1A-1D. FIG. 5A illustrates a perspective view of the insert container 113. FIG. 5B illustrates a cross-sectional view of the insert container 113. FIG. 5C illustrates a bottom-up view of the insert container 113. FIG. 5D illustrates side view of the insert container 113, and FIG. 5E illustrates a top-down view of insert container 113.

FIG. 5A illustrates that the insert container 113 has a lip 503 that extends away from the interior of the insert container 113. The edge of the lip 503 can be adjacent to a top of a bottle 109. The edge of the bottle 109 can be flush with the edge of the lip 503, as shown in FIG. 1D. The insert container 113 has a rib 506 that extends from the exterior surface of the insert container 113. The rib 506 can be used to contact the interior surface of the bottle 109 near its opening. The rib 506 can be used to provide a friction fit between the insert container 113 and the bottle 109. The rib 506 can have a rounded shape, a semi-circle shape, a triangular shape, and other suitable shapes. The rib 506 can be formed from rubber, plastic, and other suitable elastic materials.

FIG. 5A also illustrates that the insert container 113 has a bottom port 509 that connects to the drop-tube 110 (FIGS. 1B and 1D). In FIG. 5A, the bottom port 509 is shaped as a hose barb port as one non-limiting example. Other shapes and types of fittings can be used for the bottom port 509 of the insert container 113.

FIG. 5B illustrates that the insert container 113 has an interior cavity 513. Within the interior cavity 513, the insert container 113 has an inner wall 516 that extends from the bottom surface 216. The plate 121 can be attached to a top of the inner wall 516. In the illustrated embodiment, the inner wall 516 has an annular shape. Within the interior space of the inner wall 516, a recessed platform 519 exists for positioning an o-ring 124, as shown in FIGS. 1D and 2B. The plate 121 is positioned on top of the inner wall 516 in order to keep the o-ring 124 in position. The o-ring 124 or other suitable gasket can be used to provide an air and/or water seal between the stem 111 and various portions of the insert container 113.

Reference number 521 refers to an air channel for air to enter the bottle cap assembly 112 and then enter into the interior of a bottle 109 as fluid is extracted from the interior of the bottle. For instance, after air enters through the peripheral apertures 406 of the bottle cap 106 (FIG. 4A), the air travels along the side of the interior cavity 513 of the insert container 113. As such, the air channel 521 enables air to flow between the interior side surface of the insert container 113 and the stem 111. More specifically, the air channel 521 enables the air to flow between the interior side surface of the insert container 113 and the sides of the inner wall 516 and out the bottom opening 213. Further, the recessed bottom 219 includes a lower platform 524. The lower platform 524 can be used to position an end of the stem 111. By positioning the stem 111 on the lower platform 524, the interior channel (FIG. 6B) of the stem 111 can be aligned within the bottom port 509 of the insert container 113, as shown in FIG. 1B. Also, FIG. 5D illustrates that the insert container 113 has a larger first opening 530 at a first end than the bottom opening 213 at a second end of the insert container 113.

Figure 6A:
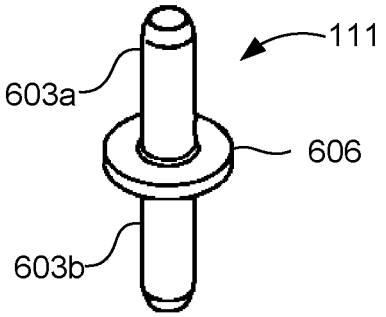
FIGS. 6A-6E illustrate various views of a stem from FIGS. 1A-1D, according to one embodiment described herein.
Figure 6B:
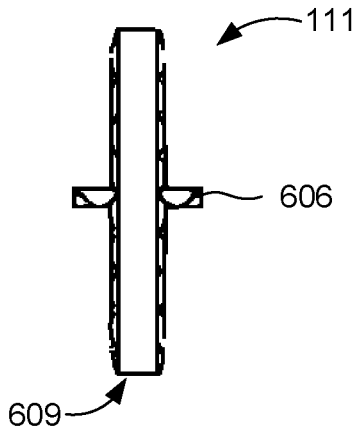
Figure 6C:
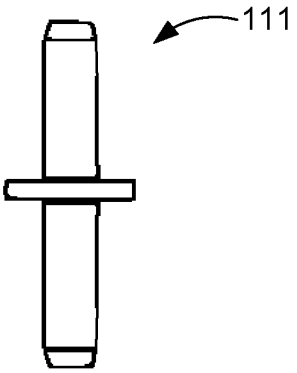
Figure 6D:
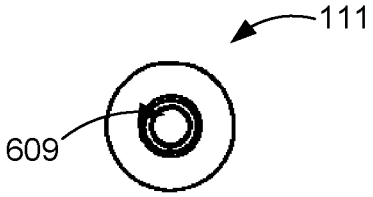

Moving on to FIG. 6A-6E, shown are various views of the stem 111 from FIGS. 1A-1D. FIG. 6A illustrates a perspective view of the stem 111. FIG. 6B illustrates a cross-sectional view of the stem 111. FIG. 6C illustrates a bottom-up view of the stem 111. FIG. 6D illustrates a side view of the stem 111.

In FIGS. 6A-6E, the stem 111 has a cylindrical shape with a first end 603*a* and a second end 603*b*. The stem 111 has a platform 606 that is positioned between the first end 603*a* and the second end 603*b*. The platform 606 extends from the exterior of the stem. In the illustrated example, the platform 606 has a circular shape and is positioned approximately mid-way between the first end 603*a* and the second end 603*b*. It should be appreciated that the shape and the position of the platform 606 can vary. When the second end 603*b* of the stem 11 is positioned on the lowered platform 524 of the insert container 113 (FIG. 1B), the platform 606 can be adjacent to the underside of the top platform 403 (FIG. 4A) as shown in FIG. 1B.

FIG. 6B illustrates that the stem 111 has an interior channel 609 that extends from the first end 603*a* through to the second end 603*b*. The interior channel 609 forms a part of the dispensing channel 114 of the bottle cap assembly 112 (FIG. 1B).

Figure 6E:
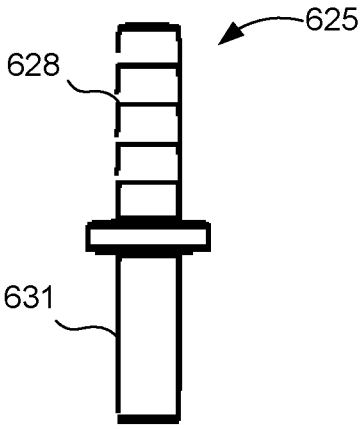

FIG. 6E illustrates an alternative stem 625 that includes a hose barb port 628 on an upper portion of the alternative stem 625. The alternative stem 625 enables for different types of connections to the bottle cap assembly 112. For example, a tube can be directly connected to the hose barb port 628, and as a result, the port fitting 103 can be omitted. The other side 631 of the alternative stem 625 is similar to the second end 603*b*.

Figure 7A:
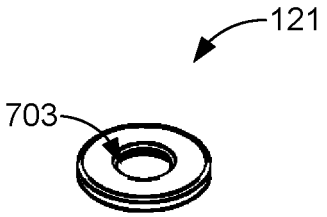
FIGS. 7A-7E illustrate various views of a plate from FIGS. 1A-1D, according to one embodiment described herein.
Figure 7B:
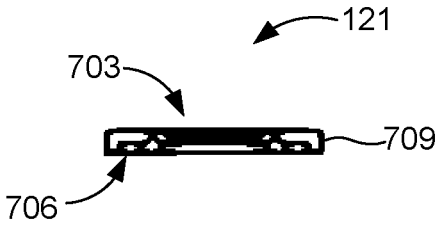
Figure 7C:
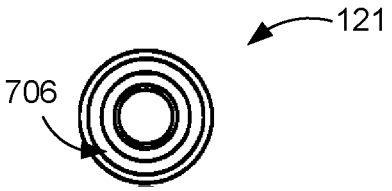
Figure 7D:
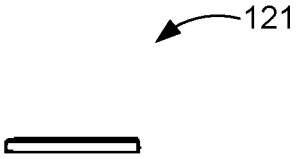
Figure 7E:
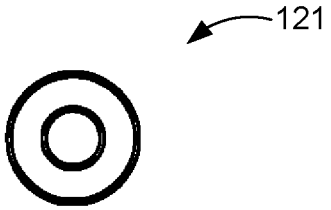

Moving on to FIG. 7A-7E, shown are various views of the plate 121 from FIGS. 1A-1D. FIG. 7A illustrates a perspective view of the plate 121. FIG. 7B illustrates a cross-sectional view of the plate 121. FIG. 7C illustrates a bottom-up view of the plate 121. FIG. 7D illustrates a side view of the plate 121, and FIG. 7E illustrates a top-down view of the plate 121.

FIGS. 7A-7C and 7E illustrate that the plate 121 has a central aperture 703. The stem 111 can be positioned in the bottle cap assembly 112 such that a portion of the stem 111 extends through the central aperture 703. On its underside, the plate 121 has a groove 706 that surrounds the central aperture 703. The top of the inner wall 516 can be positioned within the groove 706. An edge 709 of the plate 121 can hang over the top of the inner wall 516 (FIG. 1B).

The plate 121 can be used to keep the o-ring 124 positioned within the interior of the inner wall 516. The plate 121 can be attached to the top of the inner wall 516 by various methods. For examples, the plate 121 can be attached to the inner wall 516 by sonic welding, being glued, spine welding, a threaded connection, a snap-fit connection, or other appropriate coupling.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A bottle cap apparatus comprising:

a cap that has a top platform with an aperture;

an insert container that has a cylindrical shape, the insert container having a first end and second end, the first end having a first opening that is positioned adjacent to an underside of the top platform of the cap, the second end having a recessed bottom with a second opening that is smaller than the first opening;

an inner wall within an interior of the insert container, the inner wall surrounding the recessed bottom of the insert container;

a stem that has an elongated cylindrical shape, the stem having a platform between a first end and a second end, the second end of the stem being positioned within the recessed bottom of the insert container, the first end of the stem being extended through the aperture of the cap;

a gasket that is positioned between the inner wall and the stem; and a dispensing channel formed from aligning the second opening of the recessed bottom and the second end of the stem, wherein the dispensing channel is configured to allow a fluid to flow from the second opening of the recessed bottom to the first end of the stem.

2. The apparatus of claim 1, wherein the top platform has a plurality of peripheral apertures that surround the aperture.

3. The apparatus of claim 2, further comprising a filter that is positioned over the peripheral apertures.

4. The apparatus of claim 1, wherein the insert container has a plurality of peripheral openings in a bottom surface, wherein the recessed bottom extends from the bottom surface of the insert container.

5. The apparatus of claim 1, further comprising a recessed platform within an interior space of the inner wall.

6. The apparatus of claim 1, further comprising a plate that is positioned on the inner wall, wherein the plate prevents the gasket from moving away from the inner wall.

7. The apparatus of claim 6, wherein the plate has a groove, wherein a top portion of the inner wall is positioned in the groove of the plate.

8. The apparatus of claim 1, wherein the recessed bottom has a hose barb fitting that extends from the second opening.

9. The apparatus of claim 1, further comprising a drop-tube that is attached to a port of the recessed bottom.

10. The apparatus of claim 9, wherein the drop-tube comprises a slanted end.

11. The apparatus of claim 1, wherein the insert container comprises a lowered platform, wherein the second end of the stem is positioned on the lowered platform.

12. The apparatus of claim 1, wherein the first end of the stem comprises a hose barb surface.

13. The apparatus of claim 1, wherein the platform of the stem is positioned adjacent to the underside of the top platform of the cap.

14. The apparatus of claim 1, wherein the insert container comprises a lip at the first end, wherein the lip contacts a perimeter of an opening of a bottle.

15. The apparatus of claim 1, wherein the insert container having a rib that extends from an exterior of the insert container, the rib being positioned near the first end.

16. A bottle assembly, comprising:

a bottle that has a bottle opening;

a bottle cap that with an aperture, the bottle cap being configured to be screwed over the bottle opening;

an insert container that is inserted into the bottle opening, the insert container having a first end and second end, the first end having a first opening that is positioned adjacent to the bottle opening of the bottle, the second end having a recessed bottom with a second opening that is smaller than the first opening, wherein the insert container comprising an inner wall within an interior of the insert container, the inner wall surrounding the recessed bottom of the insert container;

an elongated stem having a platform between a first end and a second end, the second end of the elongated stem being positioned within the recessed bottom of the insert container, the first end of the elongated stem being extended through the aperture of the bottle cap; and a dispensing channel formed from aligning portions of the elongated stem and the insert container, wherein the dispensing channel is configured to allow a fluid to be extracted from an interior of the bottle and through the first end of the elongated stem.

17. The bottle assembly of claim 16, further comprises an o-ring that is positioned between the elongated stem and the inner wall.

18. The bottle assembly of claim 16, further comprises a plate that is positioned on top of the inner wall.

19. The bottle assembly of claim 16, wherein the bottle cap comprises a plurality of peripheral apertures that surround the aperture.

* * * * *